US007518046B1

(12) United States Patent
Kenagy et al.

(10) Patent No.: US 7,518,046 B1
(45) Date of Patent: Apr. 14, 2009

(54) WRESTPLANKS

(75) Inventors: Susan Yake Kenagy, Dix Hills, NY (US); Warren Daniel Albrecht, Holbrook, NY (US); John A. Patton, Norwalk, CT (US)

(73) Assignee: Steinway Musical Instruments, Inc., Waltham, MA (US)

( * ) Notice: Subject to any disclaimer, the term of this patent is extended or adjusted under 35 U.S.C. 154(b) by 0 days.

(21) Appl. No.: 12/015,783

(22) Filed: Jan. 17, 2008

(51) Int. Cl.
*G10C 3/04* (2006.01)

(52) U.S. Cl. ..... 84/186.1

(58) Field of Classification Search ..... 84/186.1, 84/186.2, 173, 174
See application file for complete search history.

(56) References Cited

U.S. PATENT DOCUMENTS 3,091,149 A * 5/1963 Walsh ..... 84/186.2
4,377,102 A * 3/1983 Mayerjak ..... 84/184

FOREIGN PATENT DOCUMENTS

GB 734 180 A 7/1955
GB 1 332 977 A 10/1973

OTHER PUBLICATIONS

International Search Report in counterpart application PCT/US2008/053253, dated Jul. 2, 2008.

* cited by examiner

*Primary Examiner*—Kimberly R Lockett
(74) *Attorney, Agent, or Firm*—Fish & Richardson P.C.

(57) ABSTRACT

A wrestplank includes first and second outer working plies, and at least seven median working plies stacked therebetween. Each working ply defines a direction of grain. The working plies collectively define a tuning pin hole configured to securely receive a tuning pin. The directions of grain of the outer working plies are oriented substantially parallel with respect to a longitudinal axis defined by the wrestplank. The directions of grain of two of the median working plies are oriented at an angle of between about 60° and about 75° with respect to the longitudinal axis. The directions of grain of two of the median working plies are oriented substantially perpendicular to the longitudinal axis. Furthermore, the directions of grain of two of the working plies are oriented at an angle of between about 105° and about 120° with respect to the longitudinal axis.

22 Claims, 6 Drawing Sheets

WRESTPLANKS

TECHNICAL FIELD

This disclosure relates to pin blocks (also called "wrestplanks" in the piano industry) for receiving tuning pins in pianos and like musical instruments.

BACKGROUND

A pin block or wrestplank is a laminated plank that sits under the iron plate at the front of the piano, where it defines a plurality of holes for receiving steel tuning pins. An end of each piano string is wrapped about the end of a corresponding tuning pin. The tuning pins are rotated in the pin block holes to tighten each piano string up to concert pitch. The pin blocks must hold the tuning pin tightly enough against loosening to allow the piano to stay in tune.

Multi-laminate wood planks used for less expensive pin blocks often have layers of glue of excessive thickness or excessive quantity of layers, which may lead to tuning instability. Many pin blocks or wrestplanks include layers of wood. Constant turning of the tuning pin can rapidly wear down the wood and enlarge the tuning pin hole, which eventually reduces the ability of the pin block to hold the tuning pin against loosening.

Different manufacturers vary the number of laminations (i.e. layers) forming the pin block. For example, a Steinway piano typically contains a pin block with six or seven thick laminations, e.g. often about ⅛ inch to about 5/16 inch in thickness, of maple, beech, and/or bubinga hardwoods, with the direction of grain in each layer disposed at an angle of approximately 45° to the direction of grain in opposing surfaces of adjacent layers. Other piano manufactures provide pin blocks with seven or more laminations, in which the direction of grain in each layer is disposed substantially perpendicular to the direction of grain in opposing surfaces of adjacent layers.

SUMMARY

In one aspect, a wrestplank, for use in a stringed instrument, includes first and second outer working plies, and at least seven median working plies stacked in between the first and second outer working plies. Each working ply defines a direction of grain. The working plies collectively define a tuning pin hole configured to securely receive a tuning pin. The tuning pin is substantially surrounded by and in engagement with end wood of the working plies. The directions of grain of the outer working plies are oriented substantially parallel with respect to a longitudinal axis defined by the wrestplank. The directions of grain of two of the median working plies are oriented at an angle of between about 60° and about 75°, preferably about 60°, with respect to the longitudinal axis. The directions of grain of two of the median working plies are oriented substantially perpendicular to the longitudinal axis. Furthermore, the directions of grain of two of the working plies are oriented at an angle of between about 105° and about 120°, preferably about 120°, with respect to the longitudinal axis. In some implementations, the directions of grain of at least one of the median working plies are oriented substantially parallel to the longitudinal axis. The median working plies may be stacked in a symmetric order with respect to the orientation of their directions of grain.

In another aspect, a wrestplank, for use in a stringed instrument, includes first and second outer working plies, and nine median working plies stacked in between the first and second outer working plies, each working ply defining a direction of grain. The working plies collectively define a tuning pin hole configured to securely receive a tuning pin. The tuning pin is substantially surrounded by and in engagement with end wood of the working plies. The directions of grain of the outer working plies are oriented substantially parallel with respect to a longitudinal axis defined by the wrestplank. The directions of grain of the first and ninth median working plies are oriented substantially perpendicular to the longitudinal axis, and the directions of grain of the second, fifth, and eighth median working plies are oriented substantially parallel to the longitudinal axis. The directions of grain of the third and seventh median working plies are oriented at an angle of between about 60° and about 75°, preferably about 60°, with respect to the longitudinal axis, and the directions of grain of the fourth and sixth median working plies are oriented at an angle of between about 105° and about 120°, preferably about 120°, with respect to the longitudinal axis.

Implementations of the disclosure may include one or more of the following features. In some implementations, each working ply is adhered to an adjacent working ply. Each working ply comprises rotary cut wood, in some examples. However, other appropriate cuts of wood may be used as well, such as quarter-sawn wood or flat sawn wood. For example, the median working plies oriented at an angle with respect to the longitudinal axis may comprise quarter sawn wood or flat sawn wood. Each working ply is made of a suitable hardwood, such as maple, beech, and/or bubinga hardwoods. In some examples, the median working plies oriented at an angle with respect to the longitudinal axis have a thickness greater than the other working plies. In other examples, each working ply has a substantially equal thickness. However, in some examples, the outer working plies have a different thickness than the median working plies. Preferably, at least the median working plies each have a thickness of at least 3 mm.

The details of one or more implementations of the disclosure are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

The present disclosure provides a multilayer wrestplank 100, also known as a pin block, which is capable of securely holding against loosening a series of tuning pins 150 subjected to the stresses of corresponding tensioned strings in a stringed instrument. In the case of a piano, each tuning pin 150 is attached to a string which is under between about 150 to about 250 pounds of tension, while the complete set of strings is under anywhere from about 30,000 to about 40,000 pounds of tension.

Figure 1:
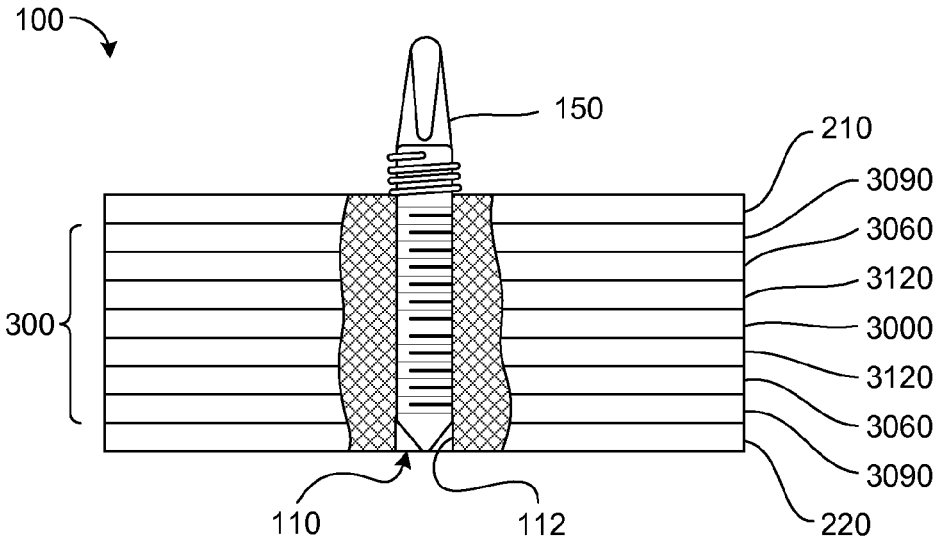
FIG. 1 is a side view of a wrestplank with nine layers or plies that are partly broken away to reveal a bore for a tuning pin.
Figure 2:
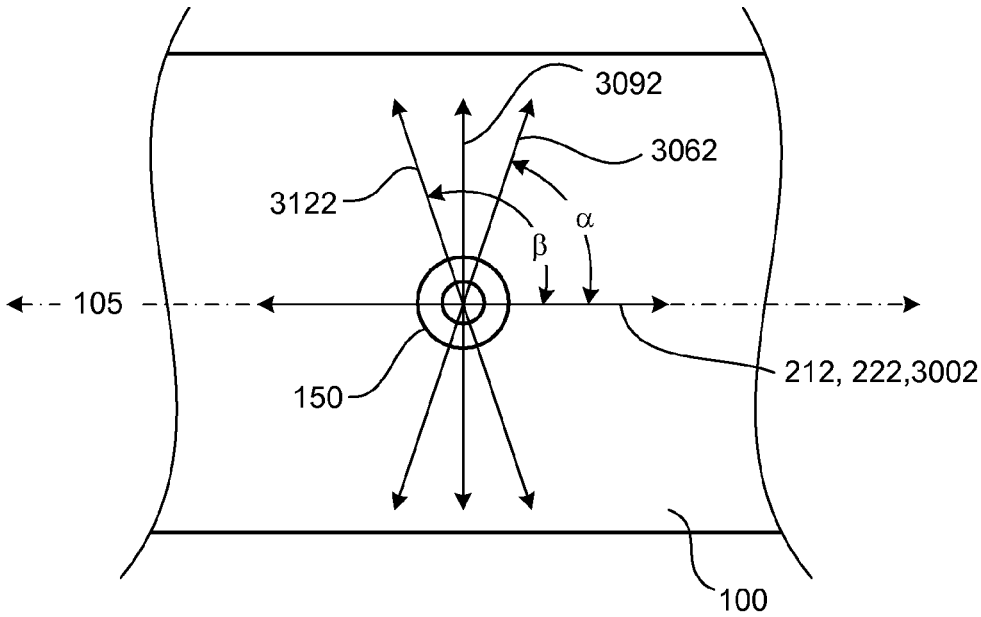
FIG. 2 is a schematic view of the position of a tuning pin with respect to the direction of grain in a wrestplank.
Figure 3:
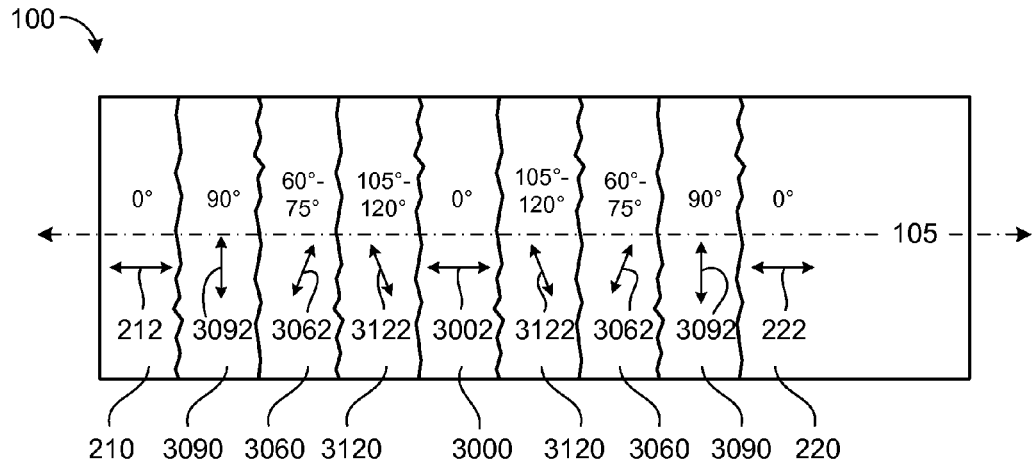
FIG. 3 is a top plan view of the wrestplank shown in FIG. 1, with its layers or plies broken away in a stepwise fashion and with double arrows indicating the direction of grain in each layer or ply.
Figure 4:
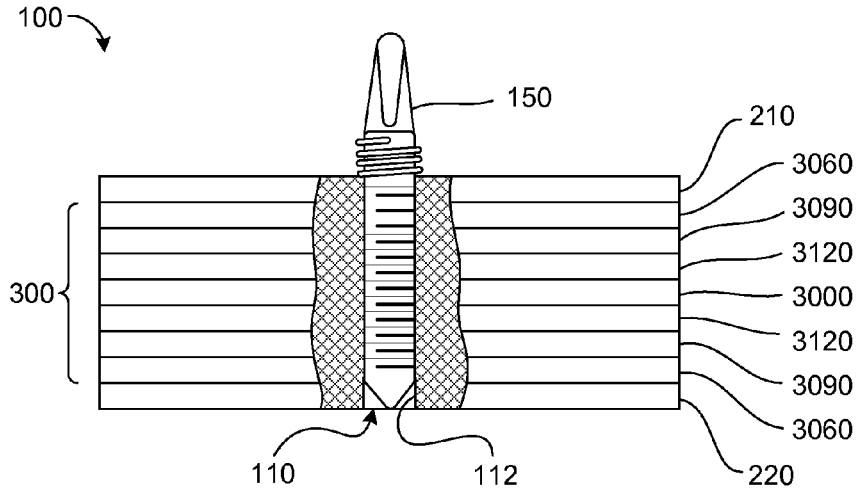
FIG. 4 is a side view of a wrestplank with nine layers or plies that are partly broken away to reveal a bore for a tuning pin.

Referring to FIGS. 1-3, in some implementations, a wrestplank 100 includes first and second outer working plies (or layers) 210 and 220, respectively, and seven or nine median working plies 300 (seven are shown) stacked in between the first and second outer working plies 210 and 220. Each working ply 210, 220 and 300 is positioned such that its grain direction is oriented at a predetermined angle with respect to the direction of grain of adjacent working plies 210, 220, 300. The working plies 210, 220 and 300 are adhered or laminated to one another, as described below, and collectively define a bore or tuning pin hole 110 configured to receive a tuning pin 150. In some examples, the tuning pin 150 is about 0.281 inches in diameter and is driven into the tuning pin hole 110 having a diameter of about 0.253 for an interference fit. The tuning pin 150 is substantially surrounded by and in engagement with end wood of the working plies 210, 220 and 300.

The multilayer wrestplank 100 provides a retaining action upon the tuning pin 150 that is relatively less dependent upon the moisture content of the surrounding air, and remains dimensionally relatively more stable under all conditions, e.g. as compared to a single layer wrestplank. The wrestplank 100, with its multi-oriented median working plies 300, substantially eliminates the so-called "slip-stick" phenomenon in retaining action upon the tuning pin 150 to provide a relatively more nearly uniform retaining action in all radial directions. The uniform retaining action allows the tuning pin 150 to be easily, exactly and firmly set in a desired position of rotation, while maintaining the qualities of easy, yet solid, tuning throughout long periods of use.

FIG. 2 is a schematic view of the position of the tuning pin 150 with respect to the direction of grain in the wrestplank 100. The wrestplank 100 includes two 60°-median working plies 3060, which have their directions of grain 3062 oriented at an angle $\alpha$ of between about 60° and about 75°, preferably about 60°, with respect to a longitudinal axis 105 defined by the wrestplank 100, and two 120°-median working plies 3120, which have their directions of grain 3122 oriented at an angle $\beta$ of between about 105° and about 120°, preferably about 120°, with respect to the longitudinal axis 105. The wrestplank 100 also includes two 90°-median working plies 3090, which have their directions of grain 3092 oriented substantially perpendicular to the longitudinal axis 105. The directions of grain 212 and 222 of the outer working plies 210 and 220, respectively, are oriented parallel with respect to the longitudinal axis 105. Some implementations include one or more 0°-median working plies 3000, which have their directions of grain 3002 oriented substantially parallel to the longitudinal axis 105. The median working plies 300 may be stacked in any order. Nevertheless, it is preferred that adjacent median plies 300, 3000, 3060, 3090, 3120 are oriented to have different directions of grain 3002, 3062, 3092, 3122 with respect to the longitudinal axis 105.

The wrestplank 100 is configured so that the direction of grain of at least one layer or working ply 210, 220, 300 is substantially parallel to the direction of maximum stress upon its associated tuning pin 150. The direction of grain orientations of the median working plies 300 provide a relatively greater percentage of end grain bearing string loads on the tuning pin 150 in a plane of maximum stress on the tuning pin 150. As demonstrated in the examples described below, the median working plies 300 may be stacked in different order or arrangements.

Figure 5:
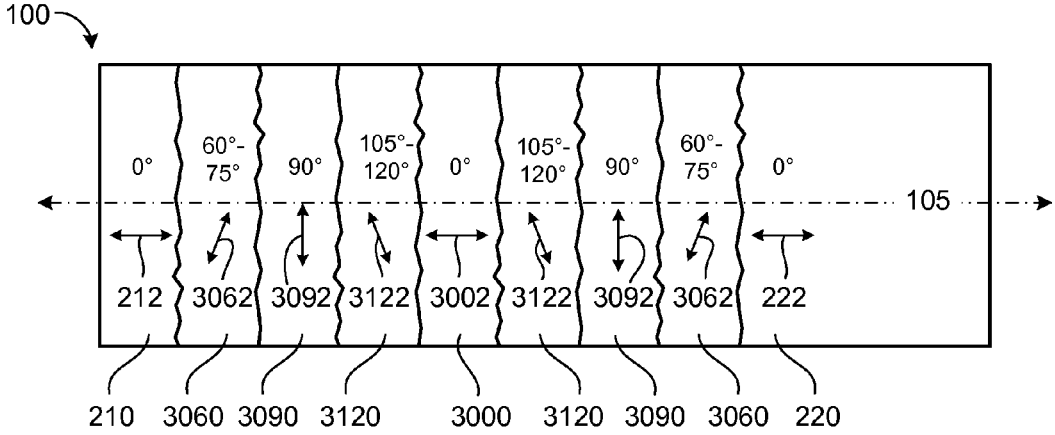
FIG. 5 is a top plan view of the wrestplank shown in FIG. 4, with its layers or plies broken away in a stepwise fashion and with double arrows indicating the direction of grain in each layer or ply.
Figure 6:
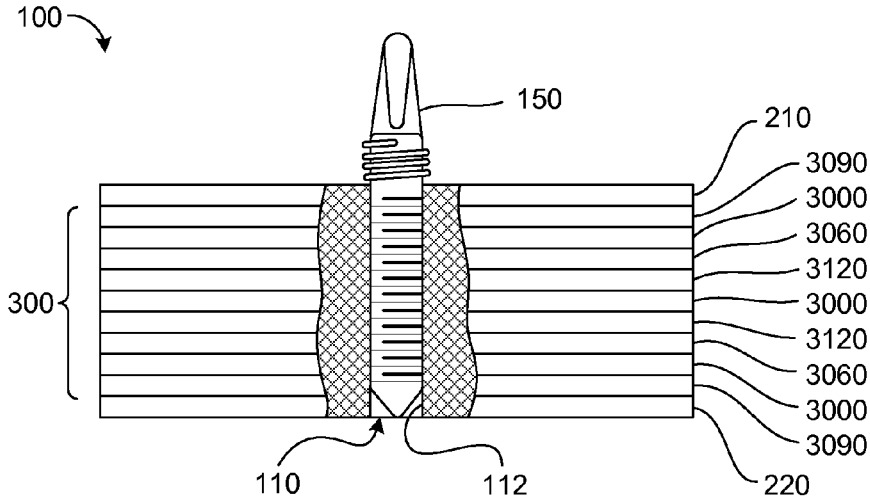
FIG. 6 is a side view of a wrestplank with 11 layers or plies that are partly broken away to reveal a bore for a tuning pin.

FIGS. 1 and 3-5 illustrate implementations of the wrestplank 100 having seven median working plies 300, nine working plies 210, 220, 300 total. FIGS. 3 and 5 provide top plan views of the implementations of the wrestplank 100 with its working plies 210, 220, 300 broken away in a stepwise fashion, and with double arrows indicating the direction of grain in each layer or working ply 210, 220, 300. The directions of grain 212 and 222 of the outer working plies 210 and 220, respectively, are oriented parallel with respect to the longitudinal axis 105 defined by the wrestplank 100. In the example illustrated in FIGS. 1 and 3, the order of the median working plies 300, from bottom to top, stacked between the first and second outer working plies 210, 220 is one of the 90°-median working plies 3090 first, one of the 60°-median working plies 3060 second, one of the 120°-median working plies 3120 third, one of the 0°-median working plies 3000 fourth, one of the 120°-median working plies 3120 fifth, one of the 60°-median working plies 3060 sixth, and one of the 90°-median working plies 3090 seventh. In the example illustrated in FIGS. 4-5, the order of the median working plies 300, from bottom to top, stacked between the first and second outer working plies 210, 220 is one of the 60°-median working plies 3060 first, one of the 90°-median working plies 3090 second, one of the 120°-median working plies 3120 third, one of the 0°-median working plies 3000 fourth, one of the 120°-median working plies 3120 fifth, one of the 90°-median working plies 3090 sixth, and one of the 60°-median working plies 3060 seventh.

Other permutations of layer orders are possible as well, such as symmetrical and asymmetrical orders or arrangements. For example, the order of the median working plies 300, from bottom to top, stacked between the first and second outer working plies 210, 220 may be one of the 60°-median working plies 3060 first, one of the 90°-median working plies 3090 second, one of the 120°-median working plies 3120 third, one of the 0°-median working plies 3000 fourth, one of the 60°-median working plies 3060 fifth, one of the 90°-median working plies 3090 sixth, and one of the 120°-median working plies 3120 seventh.

Figure 7:
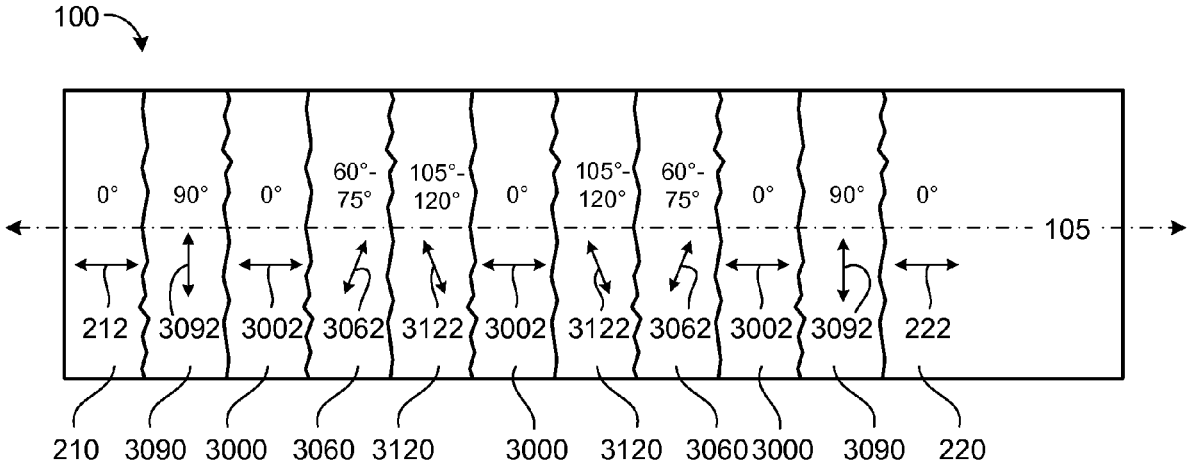
FIG. 7 is a top plan view of the wrestplank shown in FIG. 6, with its layers or plies broken away in a stepwise fashion and with double arrows indicating the direction of grain in each layer or ply.
Figure 8:
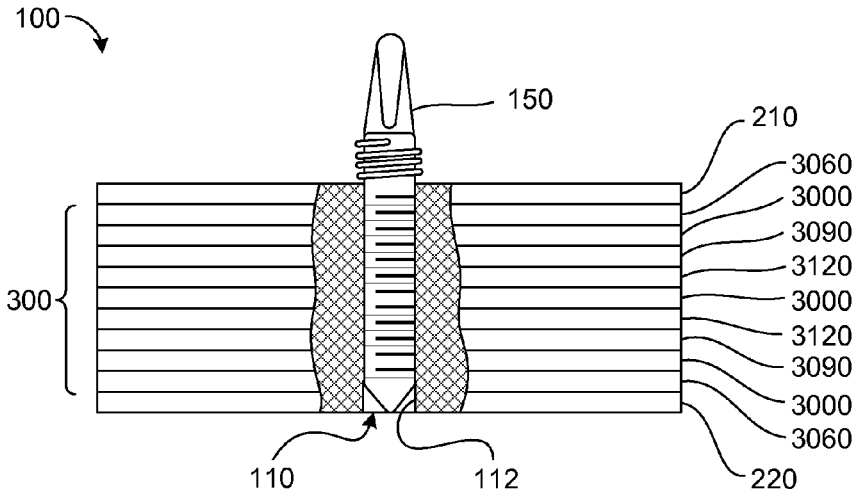
FIG. 8 is a side view of a wrestplank with 11 layers or plies that are partly broken away to reveal a bore for a tuning pin.
Figure 9:
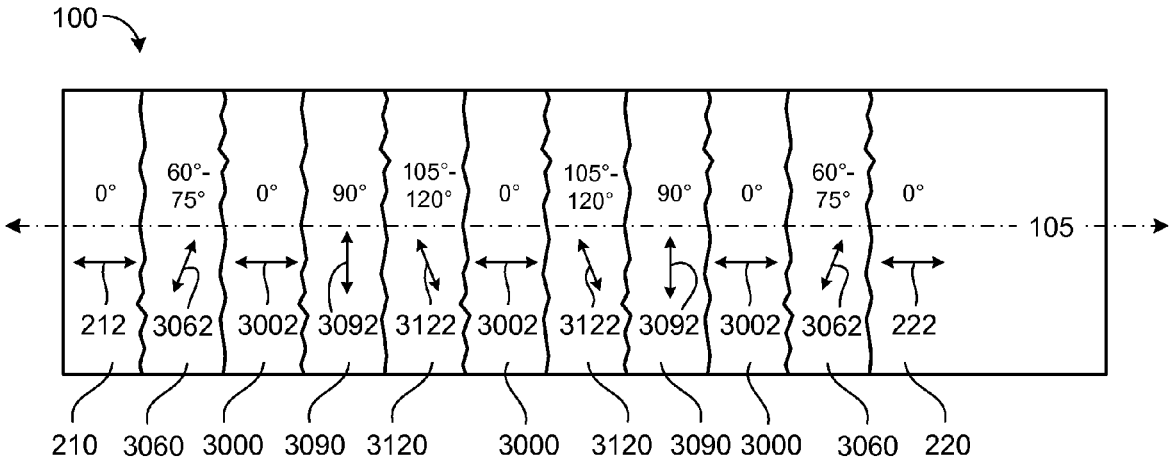
FIG. 9 is a top plan view of the wrestplank shown in FIG. 8, with its layers or plies broken away in a stepwise fashion and with double arrows indicating the direction of grain in each layer or ply.

FIGS. 6-9 illustrate implementations of the wrestplank 100 having nine median working plies 300, eleven working plies 210, 220, 300 total. FIGS. 7 and 9 provide top plan views of two implementations of the wrestplank 100 with its layers or plies 210, 220, 300 broken away in a stepwise fashion, and with double arrows indicating the direction of grain in each layer or working ply 210, 220, 300. The directions of grain 212 and 222 of the outer working plies 210 and 220, respectively, are oriented parallel with respect to the longitudinal axis 105 defined by the wrestplank 100. These implementations include two additional 0°-median working plies 3000, as compared to the examples with seven median working plies 300. In the example illustrated in FIGS. 6-7, the order of the median working plies 300, from bottom to top, stacked between the first and second outer working plies 210, 220 is one of the 90°-median working plies 3090 first, one of the 0°-median working plies 3000 second, one of the 60°-median working plies 3060 third, one of the 120°-median working plies 3120 fourth, one of the 0°-median working plies 3000 fifth, one of the 120°-median working plies 3120 sixth, one of the 60°-median working plies 3060 seventh, one of the 0°-median working plies 3000 eighth, and one of the 90°-median working plies 3090 ninth. In the example illustrated in FIGS. 8-9, the order of the median working plies 300, from bottom to top, stacked between the first and second outer working plies 210, 220 is one of the 60°-median working plies 3060 first, one of the 0°-median working plies 3000 second, one of the 90°-median working plies 3090 third, one of the 120°-median working plies 3120 fourth, one of the 0°-median working plies 3000 fifth, one of the 120°-median working plies 3120 sixth, one of the 90°-median working plies 3090 seventh, one of the 0°-median working plies 3000 eighth, and one of the 60°-median working plies 3060 ninth. Other permutations of layer orders are possible as well, such as symmetrical and asymmetrical orders or arrangements.

Each working ply 210, 220, 300 is adhered or laminated to an adjacent working ply 210, 220, 300. A urea-formaldehyde adhesive resin is preferably used. Adhesive is applied to the top surface of the second outer working ply 220. Adhesive is applied to both the top and bottom surfaces of the median working plies 300, which are then stacked on top of the second outer working ply 220. Adhesive is applied to the bottom surface of the first outer working ply 210, which is then stacked on top of the median working plies 300. The stack or book of working plies 210, 220, 300 is pressed for a period of time (e.g. until the adhesive is set) and then cured in a conditioning room, which provides a controlled environment (e.g. controlled temperature and humidity). The resulting wrestplank 100 is cut into a desired shape and assembled into a piano.

Referring again FIG. 2, which is a schematic view of the position of the tuning pin 150 with respect to the direction of grain in the wrestplank 100. The advantageous retaining action of end wood or end grain appears to be due largely to the fact that end wood is dimensionally stable, since wood does not tend to expand or contract along the grain, but rather across the grain. Data compiled by the Forest Products Laboratory, an agency of the U.S. Department of Agriculture, indicates that the compressive strength of hard maple, a material most frequently utilized in the manufacture of wrestplanks, is at least three times greater for end wood than for side grain, and that the elasticity is ten to twenty times greater for end wood than for side grain. The term "end grain" is intended to describe the exposed fibers cut transversely to the grain, i.e. end wood. Thus, the likelihood of deformation of the tuning pin hole 110 is decreased when the wrestplank 100 offers more end wood in the direction of maximum tuning pin stresses, as compared to when the tuning pin stresses act at angles across the grain (e.g. in a direction perpendicular to the grain). Such a tuning pin hole 110 offers a relatively stronger hole wall 112 (see FIG. 1) to support the tuning pin 150 and is less likely to lose its shape or fit under such loads as compared to constructions with less end wood in the plane of the greatest tuning pin load. In addition, such wrestplanks 100 offer more elastic bearing for the tuning pin 150, insuring that the tuning pin 150 is held tight and remains tight over many years of use. In contrast, wrestplank constructions with relatively larger amounts of side grain exposed in the tuning pin hole 110 will be subject to comparatively greater swelling and shrinking, which will tend to distort the tuning pin hole 110. Repeated cycles of swelling and shrinking may result in the wood taking on a compression set that compresses the fibers, further deforming the tuning pin hole 110.

Figure 10:
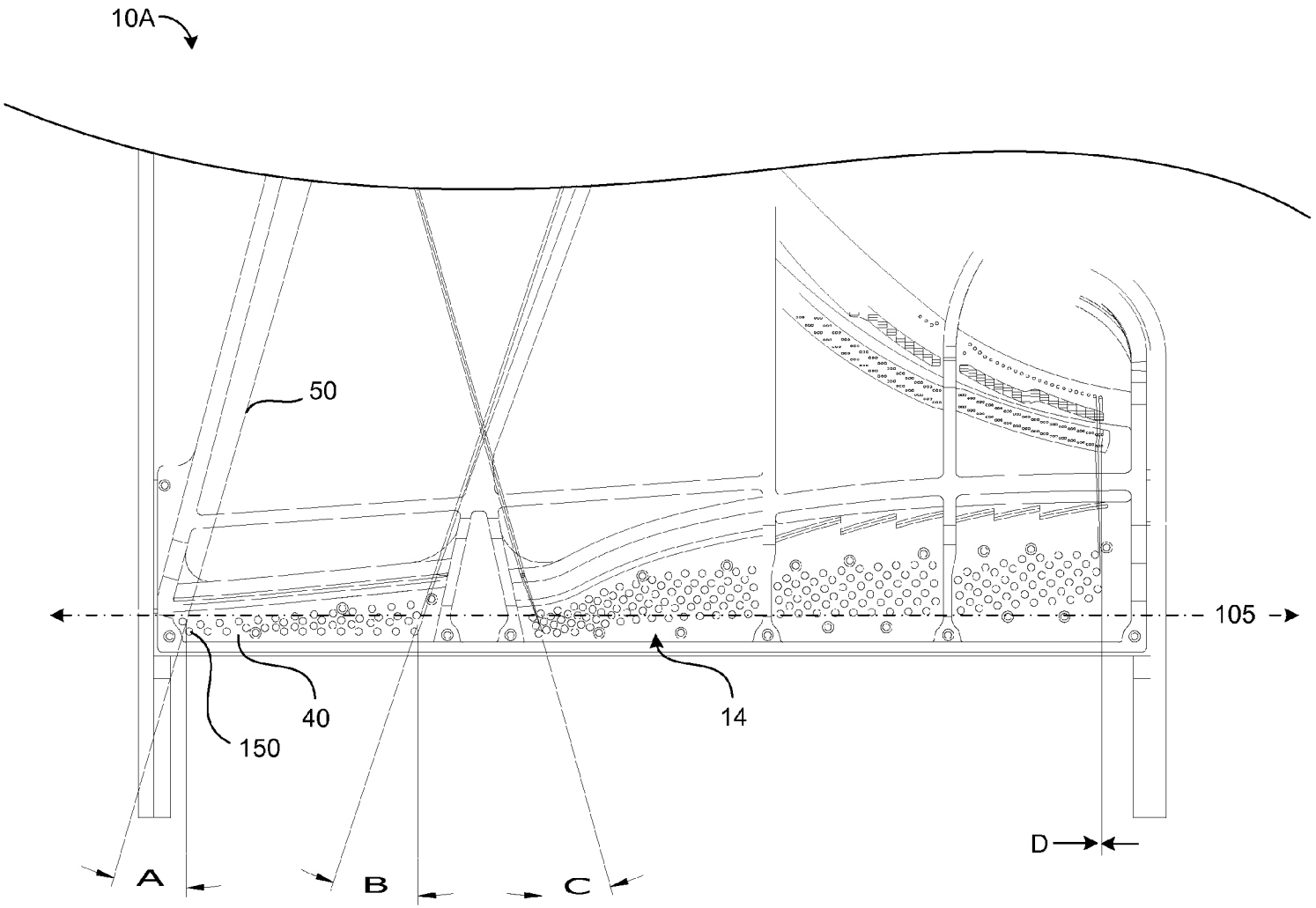
FIG. 10 is a partial top view of a horizontal or grand piano, indicating angles of string loads on tuning pins in wrestplanks.
Figure 11:
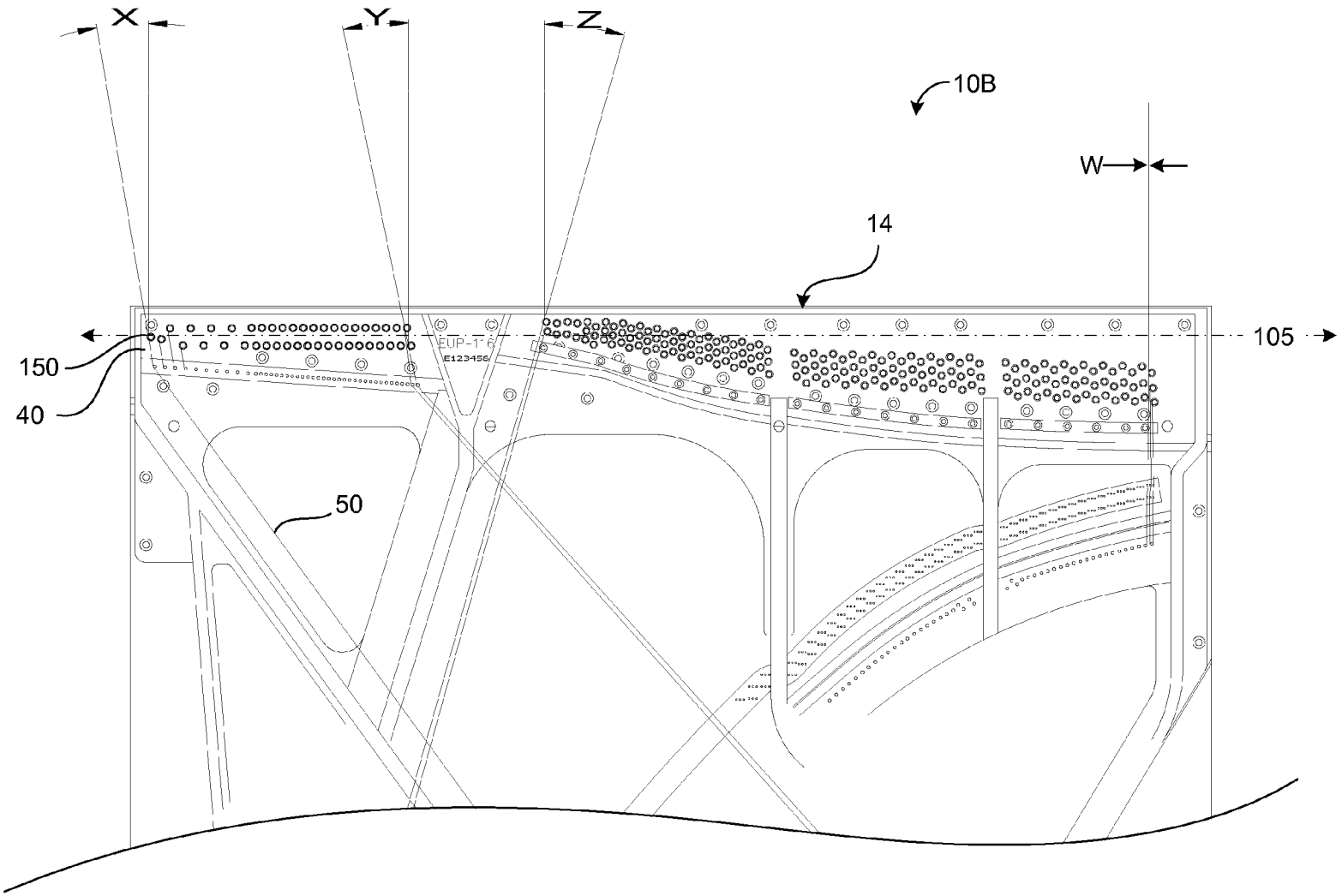
FIG. 11 is a partial front view of the back assembly of an upright piano, indicating angles of string loads on tuning pins in wrestplanks.

Deformation of the tuning pin hole 110 is greatly reduced when the direction of grain is parallel with the direction of stresses to which the tuning pins 150 are subjected by the associated strings 50 (see e.g. FIGS. 10-11). Therefore, it is desirable to orient at least one working ply 210, 220 and 300 to have at least some end grain bearing against the side of each tuning pin 150 that exerts pressure against the material of the wrestplank 100. The ruptured fibers of the end wood are believed to be primarily responsible for proper retention of the tuning pin 150. Thus, satisfactory retention of a tuning pin 150 may be assured if the wrestplank 100 is constructed in such a way as to have more end grain bearing on each tuning pin 150 in the location of maximum stress, namely, in the direction of the pull of the associated string 50. In the example of a horizontal piano 10A or an upright piano 10B, as shown in FIGS. 10 and 11, respectively, the stress is applied to the tuning pins 150 at various angles throughout the piano 10A, 10B. Consequently, the end grain should be arranged at various angles as well. For example, in treble strings, the strings 50 usually lie perpendicular to the longitudinal axis 105 of the wrestplank 100 (e.g. D=0° in FIG. 10 and W=0° in FIG. 11, both measured with respect to a reference line perpendicular to the longitudinal axis 105), the bass strings may enclose an angle, A, B, X, or Y, as shown in FIGS. 10-11, of as much as 30°, measured with respect to a reference line perpendicular to the longitudinal axis 105, and in the center section an angle, C or Z, as shown in FIGS. 10-11, is often about 25° or less, measured with respect to a reference line perpendicular to the longitudinal axis 105. The tuning pin 150 bears the greatest force against that portion of the tuning pin hole 110 which is in line with the longitudinal direction of the string 50.

FIG. 10 provides a partial top view of a horizontal or grand piano 10A, and indicates angles of string loads on tuning pins 150 held by wrestplanks 100, at various locations along the wrestplank plate assembly 14 of the piano 10A. The string load angle is measured from the longitudinal axis of the string 50 to a reference axis perpendicular to the longitudinal axis 105 of the wrestplank 100. The wrestplanks 100 are generally held in position under a tuning pin plate 40 configured to receive the tuning pins 150. In the example illustrated, the angles of the string loads on the respective wrestplanks 100 include: string load angle A equal to between about 5° and about 20°, string load angle B equal to between about 10° and about 20°, and string load angle C equal to between about 5° and about 15°. The strings 50 on the treble half of the piano 10A exert a load at an angle D of about 0°.

FIG. 11 provides a partial front view of the inside of an upright piano 20, and indicates angles of string loads on tuning pins 150 held by wrestplanks 100. In the example illustrated, the angles of the string loads on the respective wrestplanks 100 include: string load angle X equal to between about 5° and about 15°, string load angle Y equal to between about 5° and about 15°, and string load angle Z equal to between about 10° and about 25°. The strings 50 on the treble half of the piano 10A exert a load at an angle W of about 0°.

Between the horizontal piano 10A and the upright piano 10B, the maximum string load angle A, B, C, D, W, X, Y, Z is about 25°, which when applied to the tuning pin 150 results in the wrestplank 100 bearing the string load in the tuning pin hole 110 at angles of about 115° and about 65° with respect to the longitudinal axis 105. The orientations of the median working plies 300 provide end grain bearing the string loads on the tuning pin 150 substantially at angles of about 120° and about 60° with respect to the longitudinal axis 105. As a result, the wrestplank configuration described herein provides a greater percentage of end grain bearing the string loads on the tuning pin 150 than currently known wrestplanks. The resulting tuning feel of the wrestplank 100 is enhanced.

The working plies 210, 220, 300 are made of a suitable wood, preferably a carefully selected, rotary cut hard maple, mahogany-bubinga hard wood, or an equivalent hardwood. Rotary cut veneers are generally obtained by placing a log in a lathe and rotating the log along its longitudinal axis against a stationary knife. As the log revolves, the cutting knife moves slowly toward the center (varying by thickness of the veneer being cut, for instance), and a continuous sheet of veneer is peeled from the log. However, other appropriate cuts of wood may be used as well, such as quarter-sawn wood. Quarter sawn veneers are generally obtained by cutting a log longitudinally into wedges or four substantially equal "quarters" and then slicing the quarters as nearly to the radius of the log as possible into veneers of a desired thickness.

Each working ply 210, 220, 300 may have an equal thickness of about ⅛ inch, preferably 3.35 mm. Preferably, at least the median working plies each have a thickness of at least 3 mm. Equal thicknesses of the working plies 210, 220, 300 also contributes to a distribution of stresses on the wrestplank 100, and the tendency to warp or otherwise deform is less pronounced. This results in a more balanced and thus more stable wrestplank 100. In some examples, the outer working plies 210, 220 are veneers having a thickness less than the median working plies 300. In order to provide relatively more end grain bearing the string loads on the tuning pin 150, in some implementations, the 120°-median working plies 3120, 60°-median working plies 3060, and optionally the 90°-median working plies 3090 have a thickness greater than the remaining working plies 210, 220, 300, and preferably a thickness of about 6 mm. These median working plies 3060, 3090, 3120 may also be made of flat sawn or quarter sawn wood, while the remaining working plies 210, 220, 300 are made of rotary cut wood.

As mentioned earlier, wood remains hygroscopic, even when seasoned. Accordingly, wood tends to give up moisture to dry air or absorb moisture from moist air to either shrink when drying or to expand when becoming more wet. Shrinkage of the wood will cause side grain exposed to the tuning pin 150 to shrink away from the tuning pin 150 and reduce the overall area of the bearing surface for the tuning pin 150. Swelling will cause side grain exposed to the tuning pin 150 to bind unduly on the tuning pin 150 and, eventually, through compression set, reduce the bearing area or tightness still further when the wood again dries and shrinks. The tuning pin hole 110 tends to become oval. The quality of the wrestplank 100, therefore, is important to the life of the piano, and a properly designed wrestplank, made with selected well seasoned woods, may last the life of the piano if it is kept in the right climatic conditions. Since the dimensional variations of the wood are negligible along the grain but are considerable across the grain, a multi-ply construction with alternating grain directions remains comparatively stable because the adhesive bond between the working plies 210, 220, 300 will tend to prevent or at least reduce the dimensional changes in the wrestplank 100 by locking the expanding working plies 210, 220, 300; to the non-expanding working plies 210, 220, 300. It is preferred to arrange the plies 210, 220, 300 symmetrically and to use outer working plies 210, 220 of equal thicknesses and median working plies 300 or equal or greater thickness than the outer working plies 210, 220. The working plies 210, 220, 300 may be of the same kind of wood and grain figure in order to equalize the stresses and to thus balance the wrestplank 100, which will accordingly remain stable.

A number of implementations have been described. Nevertheless, it will be understood that various modifications may be made without departing from the spirit and scope of the disclosure. Accordingly, other implementations are within the scope of the following claims.

What is claimed is:

1. A wrestplank for use in a stringed instrument, the wrestplank comprising:

first and second outer working plies; and at least seven median working plies stacked in between the first and second outer working plies, each working ply defining a direction of grain;

wherein the working plies collectively define a tuning pin hole configured to securely receive a tuning pin, whereby the tuning pin is substantially surrounded by and in engagement with end wood of the working plies;

wherein the directions of grain of the outer working plies are oriented substantially parallel with respect to a longitudinal axis defined by the wrestplank; and wherein the directions of grain of two of the median working plies are oriented at an angle of between about 60° and about 75° with respect to the longitudinal axis, the directions of grain of two of the median working plies are oriented substantially perpendicular to the longitudinal axis, and the directions of grain of two of the working plies are oriented at an angle of between about 105° and about 120° with respect to the longitudinal axis.

2. The wrestplank of claim 1, wherein the directions of grain of two of the median working plies are oriented at an angle of about 60° with respect to the longitudinal axis.

3. The wrestplank of claim 1, wherein the directions of grain of two of the median working plies are oriented at an angle of about 120° with respect to the longitudinal axis.

4. The wrestplank of claim 1, wherein the directions of grain of at least one of the median working plies are oriented substantially parallel to the longitudinal axis.

5. The wrestplank of claim 1, wherein the median working plies oriented at an angle with respect to the longitudinal axis have a thickness greater than the other working plies.

6. The wrestplank of claim 1, wherein each working ply has a substantially equal thickness.

7. The wrestplank of claim 1, wherein the median working plies oriented at an angle with respect to the longitudinal axis comprise quarter sawn wood.

8. The wrestplank of claim 1, wherein the median working plies oriented at an angle with respect to the longitudinal axis comprise flat sawn wood.

9. The wrestplank of claim 1, wherein each working ply comprises rotary cut wood.

10. The wrestplank of claim 1, wherein each working ply comprises maple hardwood.

11. The wrestplank of claim 1, wherein each working ply is adhered to an adjacent working ply.

12. The wrestplank of claim 1, wherein the median working plies are stacked in a symmetric order with respect to the orientation of their directions of grain.

13. A wrestplank for use in a stringed instrument, the wrestplank comprising:

first and second outer working plies; and nine median working plies stacked in between the first and second outer working plies, each working ply defining a direction of grain;

wherein the working plies collectively define a tuning pin hole configured to securely receive a tuning pin, whereby the tuning pin is substantially surrounded by and in engagement with end wood of the working plies;

wherein the directions of grain of the outer working plies are oriented substantially parallel with respect to a longitudinal axis defined by the wrestplank; and wherein the directions of grain of the first and ninth median working plies are oriented substantially perpendicular to the longitudinal axis, the directions of grain of the second, fifth, and eighth median working plies are oriented substantially parallel to the longitudinal axis, the directions of grain of the third and seventh median working plies are oriented at an angle of between about 60° and about 75° with respect to the longitudinal axis, and the directions of grain of the fourth and sixth median working plies are oriented at an angle of between about 105° and about 120° with respect to the longitudinal axis.

14. The wrestplank of claim 13, wherein the directions of grain of two of the median working plies are oriented at an angle of about 60° with respect to the longitudinal axis.

15. The wrestplank of claim 13, wherein the directions of grain of two of the median working plies are oriented at an angle of about 120° with respect to the longitudinal axis.

16. The wrestplank of claim 13, wherein the median working plies oriented at an angle with respect to the longitudinal axis have a thickness greater than the other working plies.

17. The wrestplank of claim 13, wherein each working ply has a substantially equal thickness.

18. The wrestplank of claim 13, wherein the median working plies oriented at an angle with respect to the longitudinal axis comprise quarter sawn wood.

19. The wrestplank of claim 13, wherein the median working plies oriented at an angle with respect to the longitudinal axis comprise flat sawn wood.

20. The wrestplank of claim 13, wherein each working ply comprises rotary cut wood.

21. The wrestplank of claim 13, wherein each working ply comprises maple hardwood.

22. The wrestplank of claim 13, wherein each working ply is adhered to an adjacent working ply.

* * * * *